US011092390B2

(12) United States Patent
Tournois et al.

(10) Patent No.: US 11,092,390 B2
(45) Date of Patent: Aug. 17, 2021

(54) COLLECTOR PLATE FOR A MOTOR VEHICLE HEAT EXCHANGER

(71) Applicant: Valeo Systemes Thermiques, Le Mesnil-Saint-Denis (FR)

(72) Inventors: Rémi Tournois, Le Mesnil Saint-Denis (FR); Yves Seynat, Reims (FR); Christian Riondet, Reims (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 36 days.

(21) Appl. No.: 16/345,518

(22) PCT Filed: Oct. 27, 2017

(86) PCT No.: PCT/FR2017/052973
§ 371 (c)(1),
(2) Date: Apr. 26, 2019

(87) PCT Pub. No.: WO2018/078300
PCT Pub. Date: May 3, 2018

(65) Prior Publication Data

US 2019/0277583 A1 Sep. 12, 2019

(30) Foreign Application Priority Data

Oct. 28, 2016 (FR) ..... 1660539

(51) Int. Cl.
*F28F 9/02* (2006.01)

(52) U.S. Cl.
CPC ..... *F28F 9/0226* (2013.01); *F28F 9/0224* (2013.01)

(58) Field of Classification Search
CPC ..... F28F 9/02; F28F 9/0224; F28F 9/0226
See application file for complete search history.

(56) References Cited

U.S. PATENT DOCUMENTS 4,881,594 A * 11/1989 Beamer ..... F28F 9/0226 165/173
5,201,368 A * 4/1993 Kroetsch ..... F28F 9/0226 165/149

(Continued)

FOREIGN PATENT DOCUMENTS

DE 102006006946 A1 * 8/2007 ..... F28F 1/126
EP 0270433 A1 * 6/1988 ..... F28F 9/0214

(Continued)

OTHER PUBLICATIONS

JP-2003130580-A mt (Year: 2003).*

(Continued)

*Primary Examiner* — Gordon A Jones
(74) *Attorney, Agent, or Firm* — Osha Bergman Watanabe & Burton LLP

(57) ABSTRACT

A collector plate for a motor vehicle heat exchanger may include a first receiving zone for tubes of a first tube bundle of a heat exchanger. The collector plate may include a second receiving zone for tubes of a second tube bundle of a heat exchanger and a groove extending between the first and second receiving zones. The collector plate may be thinner in a region of the groove. Further, the collector plate may have a channel reducing the thickness of the collector plate from a first face of the collector plate and opposing a second face of the collector plate including the groove.

15 Claims, 4 Drawing Sheets

(56) References Cited

U.S. PATENT DOCUMENTS

| | | | | | |
|---|---|---|---|---|---|
| 5,664,625 | A * | 9/1997 | Letrange | F28F 9/02 | 165/149 |
| 6,988,544 | B2 * | 1/2006 | Ozaki | F28F 9/182 | 165/152 |
| 8,944,154 | B2 * | 2/2015 | Takahashi | F28F 9/0226 | 165/140 |
| 2008/0296007 | A1 * | 12/2008 | Harris | F28F 9/0246 | 165/178 |
| 2020/0166277 | A1 * | 5/2020 | Foerster | F28F 9/182 | |
| 2020/0166294 | A1 * | 5/2020 | Dolderer | F28F 9/0212 | |

FOREIGN PATENT DOCUMENTS

| | | | | | |
|---|---|---|---|---|---|
| EP | 767354 | A1 | | 4/1997 | |
| EP | 1462753 | A2 | | 9/2004 | |
| EP | 1462754 | A2 | | 9/2004 | |
| FR | 2785376 | A1 | | 5/2000 | |
| JP | 11-51592 | | * | 4/1997 | F28F 9/18 |
| JP | 2003130580 | A | * | 5/2003 | F28F 9/0226 |

OTHER PUBLICATIONS

JP11-51592 abs mt (Year: 1997).*
EP 0270433 A1 mt (Year: 1988).*
DE102006006946A1 mt (Year: 2007).*
International Search Report and Written Opinion in corresponding International Application No. PCT/FR2017/052973, dated Jan. 2, 2018 (10 pages).

* cited by examiner

COLLECTOR PLATE FOR A MOTOR VEHICLE HEAT EXCHANGER

The present invention relates to a collector plate for a motor vehicle heat exchanger and a heat exchanger provided with such a collector plate.

A heat exchanger conventionally comprises a tube bundle delimited by two terminal tubes. In addition, heat exchange fins may be provided between the tubes of the bundle in order to improve the heat exchange. A terminal heat exchange fin may be arranged on the external face of each of the terminal tubes. The terminal heat exchange fin(s) thus delimit(s) the tube bundle. A cheek is arranged directly on each of the aforementioned terminal heat exchange fins.

A heat exchanger further comprises two collector plates (or "collectors") which are traversed by the ends of the tubes of the tube bundle. The collector plates are each covered by a cover in order to form a water chamber. In this particular case, a first water chamber permits the distribution of the fluid traversing the tubes from a fluid inlet formed by a first cover. The second water chamber permits the collection of the fluid which has traversed the tubes in order to conduct the fluid to a fluid outlet of the heat exchanger, which is formed by the second cover.

In the automotive field, in particular, a heat exchanger may comprise two bundles of tubes which are parallel and offset to one another in a direction perpendicular to the two bundles of tubes, successively traversed by the fluid to be cooled or heated. In this case, the fluid inlet and outlet may be arranged in the region of the same end of the bundles of tubes and formed by the same cover, the water chamber located at the other end permitting the fluid to be guided from the outlet of the tubes of the first tube bundle which are traversed, to the inlet of the tubes of the second tube bundle to be traversed.

In this case, the tubes of the two bundles of tubes are traversed by the fluid at different temperatures. This results in different expansions of the tubes between the first bundle which is passed through by a hotter fluid and the second bundle which is passed through by a colder fluid. These different expansions may cause cracks or further damage in the collector plates to which the tubes are fixed, which impair the seal which is required to guide the fluid effectively.

These effects of the different expansions of the tubes may be accentuated when the collector plate comprises a groove for receiving a seal ring, which makes the collector plate more rigid.

These different expansions are also particularly noticeable in the region of the collector plate of the water chamber inlet and outlet which is in direct contact with the hotter liquid and the colder liquid. This collector plate may then have different expansions which are also capable of causing damage to the collector plate, impairing its seal.

An object of the invention is to provide a collector plate which makes it possible to reduce, or even avoid completely, the appearance of cracks and/or damage.

To this end, the invention proposes a collector plate for a motor vehicle heat exchanger, comprising a first receiving zone for tubes of a first tube bundle of a heat exchanger, and a second receiving zone for tubes of a second tube bundle of a heat exchanger, the collector plate having a groove, the groove extending between the first and second receiving zones, the collector plate being thinner in the region of the groove.

Thus the thinning of the plate in the region of the groove makes it possible to create a "deformation notch" enabling the collector plate to be made more flexible and to facilitate the adaptation of the collector plate to the different expansions of the tubes of the first and second bundles. In particular, this thinning which is located between the two aforementioned parts facilitates the relative pivoting of these two parts about this thinning.

According to preferred embodiments of the invention, the collector plate comprises one or more of the following features, taken individually or in combination:

- the thinning in the region of the groove corresponds to a minimum thickness of the collector plate in the region of the groove, which is greater than 50% and/or less than 75% of a maximum thickness of the collector plate in the region of the groove;
- the groove is defined by a fold of the collector plate;
- the fold has a U-shaped cross section;
- the thinning of the collector plate is located in the region of one or more angles of the U-shaped cross section of the fold;
- the collector plate has a channel or a deformation reducing the thickness of the collector plate on one face of the collector plate, opposing the face of the collector plate with the groove;
- on one face of the collector plate the groove is designed to be oriented toward a cover forming with the collector plate at least one water chamber;
- the collector plate is of substantially rectangular shape, preferably with rounded corners and the groove extends in a longitudinal direction of the collector plate;
- the first and/or the second receiving zones for tubes comprise a plurality of slots which are preferably parallel, each slot being preferably designed to be traversed by the end of one respective tube;
- each slot is at the top of a projection of the collector plate, the projection being preferably of oblong shape, the length of the oblong shape being further preferably substantially perpendicular to the groove and the projection preferably protruding from the face of the collector plate with the groove;
- the collector plate forms a recess about the first and second receiving zones, the groove leading into the recess on either side.

According to a further feature, the invention relates to a heat exchange device for a motor vehicle, in particular to a radiator for cooling the engine of a motor vehicle, with two methodical passes, comprising a first and a second tube bundle, a first collector plate and a second collector plate, at least one first cover, preferably a single first cover fixed to the first collector plate and forming a water inlet and a water outlet, and a second cover fixed to the second collector plate and forming a guide for the water between the first tube bundle and the second tube bundle, the first collector plate being as described above in all of its combinations.

Preferably the heat exchanger according to the invention comprises one or more of the following features, taken individually or in combination:

- the heat exchange device also comprises a first seal ring which is received in the groove of the first collector plate, arranged between the first collector plate and a wall of the first cover in order to separate a distribution space, which places the water inlet and the first tube bundle in fluidic communication, from a collection space, which places the water outlet and the second tube bundle in fluidic communication, the seal ring being preferably of U-shaped cross section;

the recess receiving a single second seal ring clamped between the first collector plate and a wall of the first cover, the seal ring preferably being of U-shaped cross section; and the second seal ring has the shape of a figure of eight with a central arm, the central arm forming the first seal ring which is received in the groove of the first collector plate.

The invention will be understood more clearly by reading the following non-limiting description which is provided by way of illustration with reference to the accompanying drawings, in which.

In the remainder of the description, elements which are identical or of identical function bear the same reference numeral. For the purpose of a concise description, only the differences between the embodiments shown are described.

Figure 1:
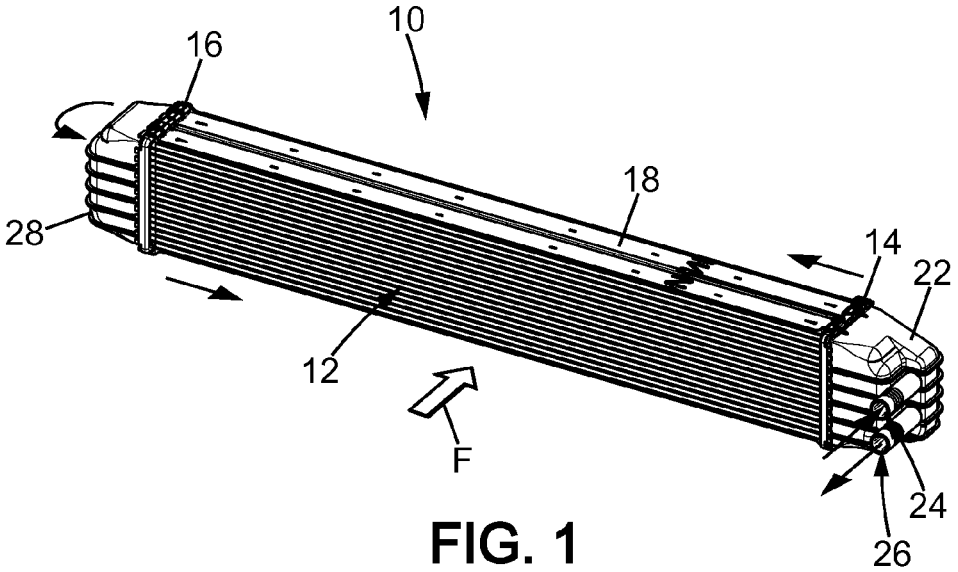
FIGS. 1 and 2 show a heat exchanger for a motor vehicle respectively in perspective and in front view.
Figure 2:
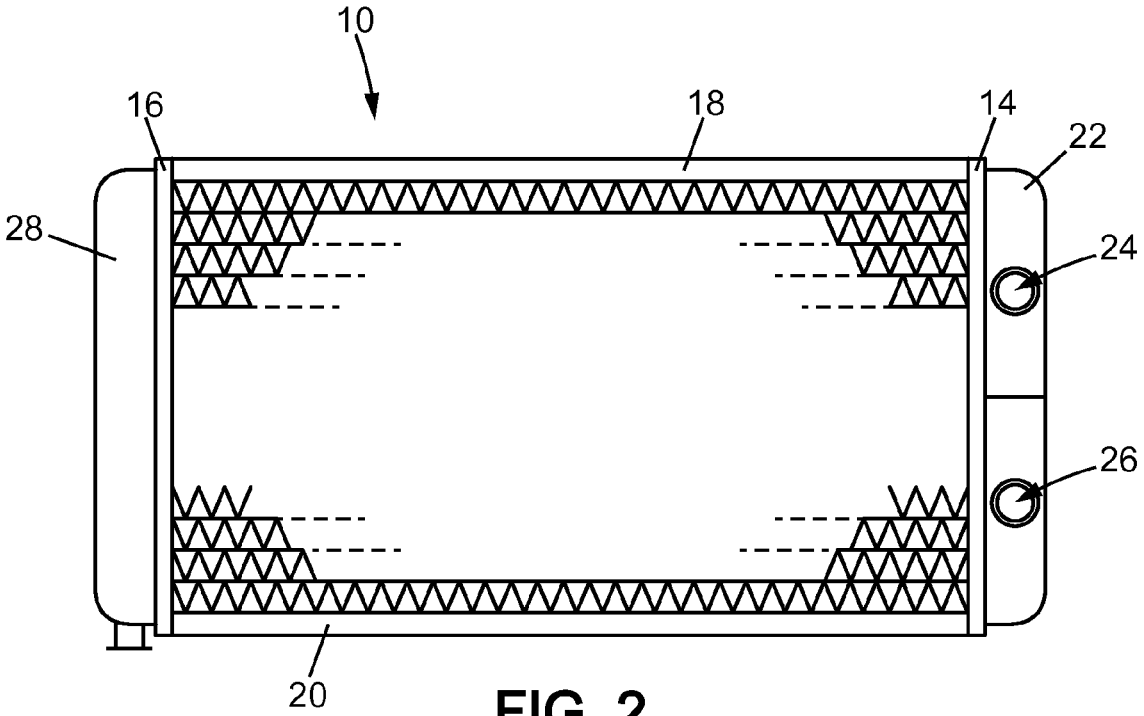

FIGS. 1 and 2 illustrate an embodiment of a heat exchanger 10 (or thermal exchanger). In this particular case, it is a heat exchanger with two methodical passes for cooling the gearbox and the engine of a motor vehicle. Such an exchanger may, for example, cool the water which traverses therethrough, by means of an airflow F created by the speed of displacement of the motor vehicle.

The heat exchanger 10 essentially comprises two bundles of tubes 12 (only one thereof being visible in FIGS. 1 and 2) extending in two parallel planes which are offset relative to one another in a direction perpendicular to the planes. The bundles of tubes are assembled between two collector plates 14, 16 receiving the ends of the tubes 12 and two lateral cheeks 18, 20. The collector plates 14, 16 are of generally rectangular shape, in this particular case with rounded corners. The collector plates 14, 16 may be made of metal, in particular aluminum.

A first cover 22 is fixed to the collector plate 14 located at a first longitudinal end of the heat exchanger 10, the assembly thus formed sometimes being called a water chamber. The first cover 22 forms a water inlet 24 and a water outlet 26 of the heat exchanger 10. The first cover 22 also forms with the collector plate 14 two spaces:

a first so-called distribution space places the water inlet 24 in fluidic communication with a first tube bundle, in this particular case the tube bundle which is not visible in the figure, designed to be placed downstream relative to the direction of the propagation of the cooling airflow F;

a second so-called collection space places the water outlet 26 in fluidic communication with the second tube bundle.

A second cover 28 is fixed to the collector plate 16 located at the second end of the heat exchanger 10 opposing the first end. This second cover 28 defines with the collector plate 16 a hollow space which places the first and second bundles of tubes 12 in fluidic communication.

The operation of this heat exchanger 10 may be summarized as follows:

the hot water enters the heat exchange device 10 via the water inlet 24;

the hot water traverses the distribution space formed by the first cover 22 and the collector plate 14 toward the first tube bundle 12 located downstream relative to the second tube bundle 12 in the direction of the flow of air F, this first tube bundle 12 thus being in contact with the air previously heated by the contact with the second tube bundle 12;

at the end of the heat exchanger 10 opposing the water inlet 24, the water makes a half turn guided by the cover 28 which conducts the water toward the second tube bundle 12;

the water then traverses this second tube bundle 12 until it reaches the collection space formed by the first cover 22 and the collector plate 14, which conducts the cooled water to the water outlet 26.

Thus the first tube bundle 12 is traversed by fluid which is generally hotter than the fluid traversing the second tube bundle 12. As a result, the tubes of the first tube bundle expand to a greater extent than the tubes of the second tube bundle. Since these two bundles of tubes 12 are fixed to the two collector plates 14, 16, in particular by brazing, the different expansions of the tubes produce forces on the collector plates in a direction substantially parallel to the direction of extension of the tubes, and thus substantially perpendicular to the planes of the collector plates 14, 16.

However, as described below, the collector plate 14 is designed in this case to limit the effects of these expansions, in particular in order to avoid the risks of the appearance of cracks or other more significant damage which could impair the seal of the collector plates 14, 16, making the heat exchange device 10 ineffective or, at the very least, less efficient.

Figure 3:
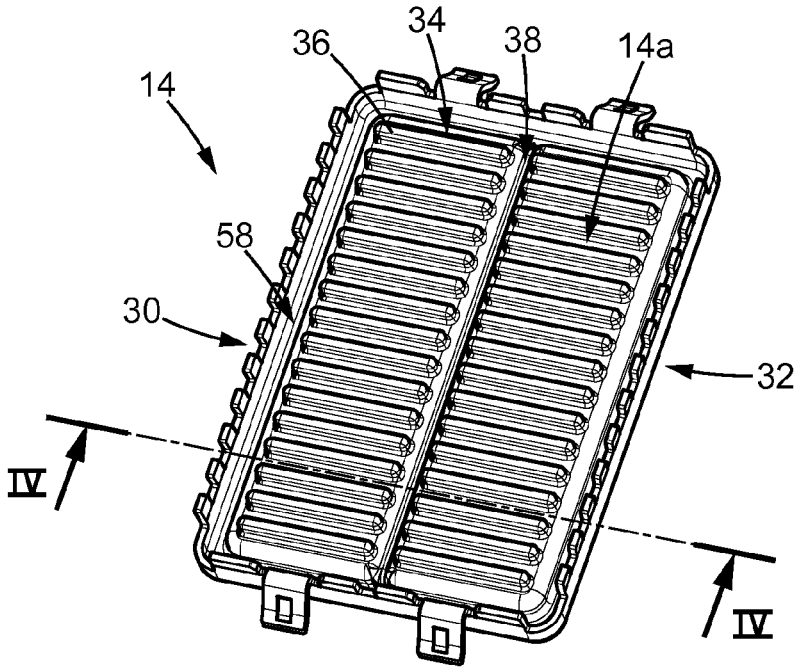
FIGS. 3 and 4 illustrate a collector plate of the heat exchanger of FIG. 1 respectively in perspective and in section along the line IV-IV.
Figure 4:
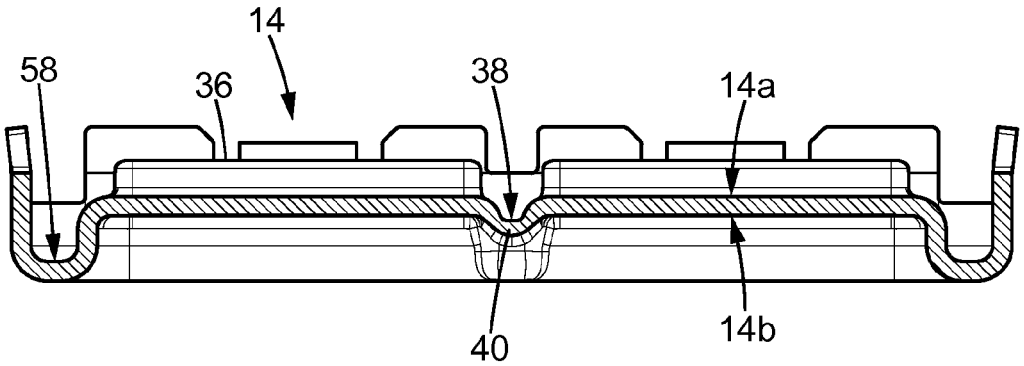

Thus as illustrated in FIG. 3, which shows a face 14*a* of the collector plate—hereinafter the internal face 14*a*—designed to be oriented toward the first cover 22 and opposite the face 14*b* referenced in FIG. 4 ~hereinafter the external face, the collector plate 14 comprises two zones 30, 32 for receiving tubes of the first and second bundles 12 of tubes. In this case, these zones are symmetrical relative to a longitudinal median plane of the plate 14. Each receiving zone 30, 32 is formed from substantially half of the collector plate 14. Each receiving zone for the tubes 30, 32 comprises, for example, the same number of slots 34 for receiving tubes of the tube bundle 12, the slots 34 being traversed by the end of the tubes so that these lead respectively into the distribution space or into the collection space defined with the first cover 22. In order to ensure the seal of this assembly, the tubes may be brazed to the collector plate 14, in particular in the region of these slots 34. Moreover, the slots 34 are produced in this case at the top of reliefs or projections 36 relative to the internal face 14*a* of the collector plate 14. The projections may be of oblong shape as illustrated in FIG. 3 in order to make them more rigid and/or to adapt them to the shape of the tubes, the ends thereof being received by said projections. Preferably, in order to optimize the number of slots 34 the principal direction of the oblong shape of the projections 36 thus corresponds substantially to the width of the collector plate 14.

The two receiving zones 30, 32 are separated by a groove 38 in the internal face 14*a*. The groove 38 is designed to receive a seal ring, providing the seal between the distribution space and the collection space.

The groove 38 extends in this case in a straight line corresponding to a longitudinal direction of the collector plate 14. This shape of the groove 38 is particularly suitable for receiving a seal providing the seal between the collector plate 14 and the first cover 22, the geometry of said seal preferably being simple in order to ensure its efficiency.

In this case, the groove 38 is formed by a fold 40 of the collector plate 14. This embodiment is particularly advantageous since the fold 40 may be produced during the same stamping step as that for forming the slots 34 and/or the projections 36.

The fold 40 in this case has a U-shaped cross section. This shape of the fold 40 provides a greater flexibility thereto. More specifically and as visible in FIG. 5, in particular, the fold 40 comprises two cheeks 42, 44 about a web 46 defining the base of the groove 38. The cheeks 42, 44 form with the web an angle of between, for example, 70° and 130°. The angle between the cheeks and the web may, in particular, be defined as being the maximum angle between the tangents to the face 14*a* of the collector plate 14 in the region of the cheeks 42, 44 and a plane parallel to the plane of extension of the collector plate 14.

Figure 5:
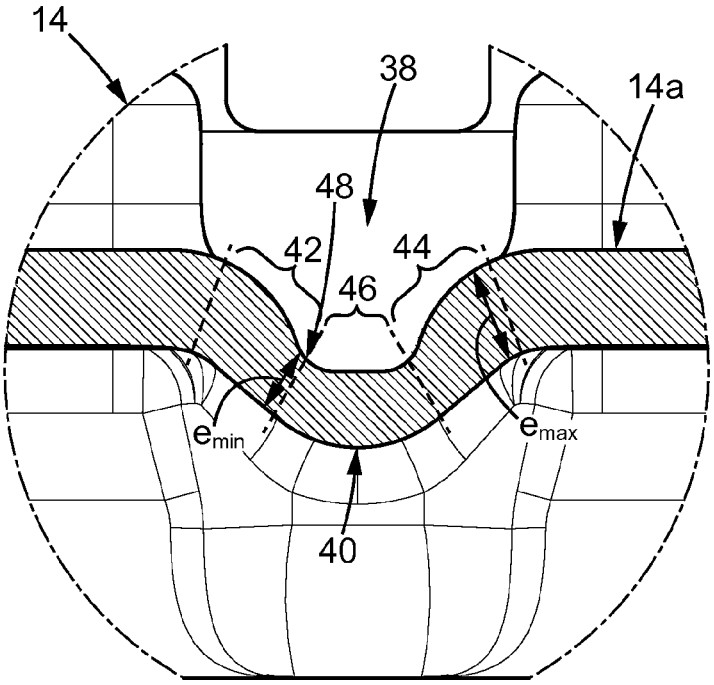
FIG. 5 illustrates a detail of FIG. 4.

As is more particularly visible in FIG. 5, the collector plate 14 has a thinning in the region of the groove 38. More specifically, in this case the thickness of the collector plate 14 is at a minimum $e_{min}$ at least locally in the region of the groove 38. This thinning may be produced substantially in the region of one or more angles of U-shaped cross section of the fold 40, i.e. in the region of the corners 48 at the junction between the cheeks 42, 44 and the web 46 of the fold 40. The thickness $e_{min}$, of the plate 14 may be between 50% and 75% of the maximum thickness $e_{max}$ of the plate 14 in the region of the fold 40. In particular, the thickness $e_{min}$ of the plate 14 may be greater than 0.8 mm and/or less than 1.2 mm. The maximum thickness $e_{max}$ of the plate 14 in the region of the fold 40 may be greater than 1 mm and/or less than 2 mm, in particular substantially equal to 1.5 mm. In this case, this maximum thickness $e_{max}$ is that of the plate 14 at the ends of the cheeks 42, 44 of the fold 40 which are not joined to the web 46. The thickness $e_{max}$ may be equal to the thickness of the plate 14 in the region of the receiving zones 30, 32, in particular in the vicinity of the groove 38.

Figure 6:
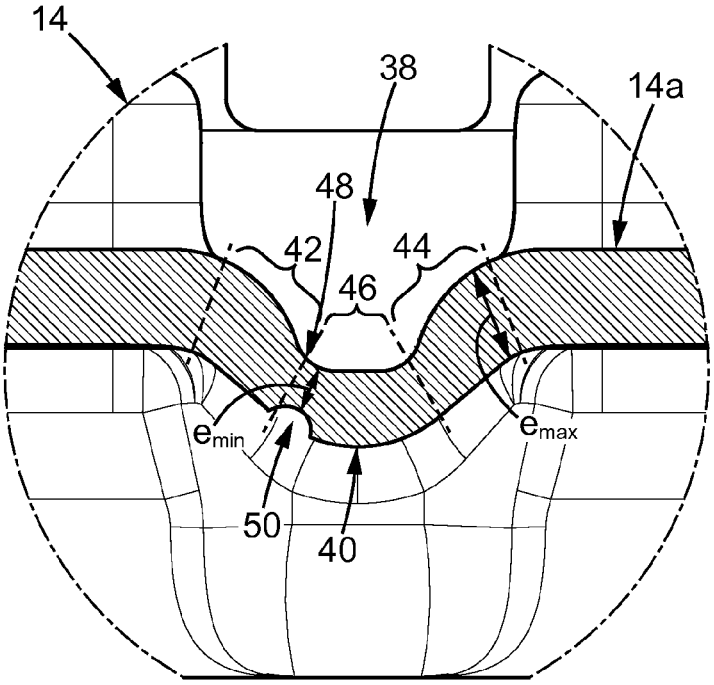
FIG. 6 illustrates a variant of the detail of FIG. 5.

FIG. 6 illustrates a variant in which the collector plate 14 has on its external face 14*b* a deformation or channel 50 forming a more significant thinning. The channel 50 is produced in the region of the groove 38. The channel 50 extends, in particular, parallel to the groove 38. The channel 50 may in turn permit a thinning of the collector plate 14 to be created in the region of the fold 40. Alternatively, however, this channel 50 is produced in addition to a thinning as described relative to FIG. 5. Particularly advantageously, the channel 50 and/or any thinning of the plate 14 in the region of the groove 38 is produced closer to the receiving zone which receives the tubes of the first tube bundle, i.e. the tubes traversed by the hotter fluid, than the receiving zone which receives the tubes of the second tube bundle, i.e. the tubes traversed by the colder fluid. In particular, when the groove is produced in the form of a fold 40 the thinning and/or groove 50 are not produced at the top of the fold 40 but are offset relative to this top, in the direction of the receiving zone of the tubes traversed by the hotter fluid. This makes it possible to facilitate the deformation of the collector plate 14 in the region of the groove 38 by rotation about the thinning.

Figure 7:
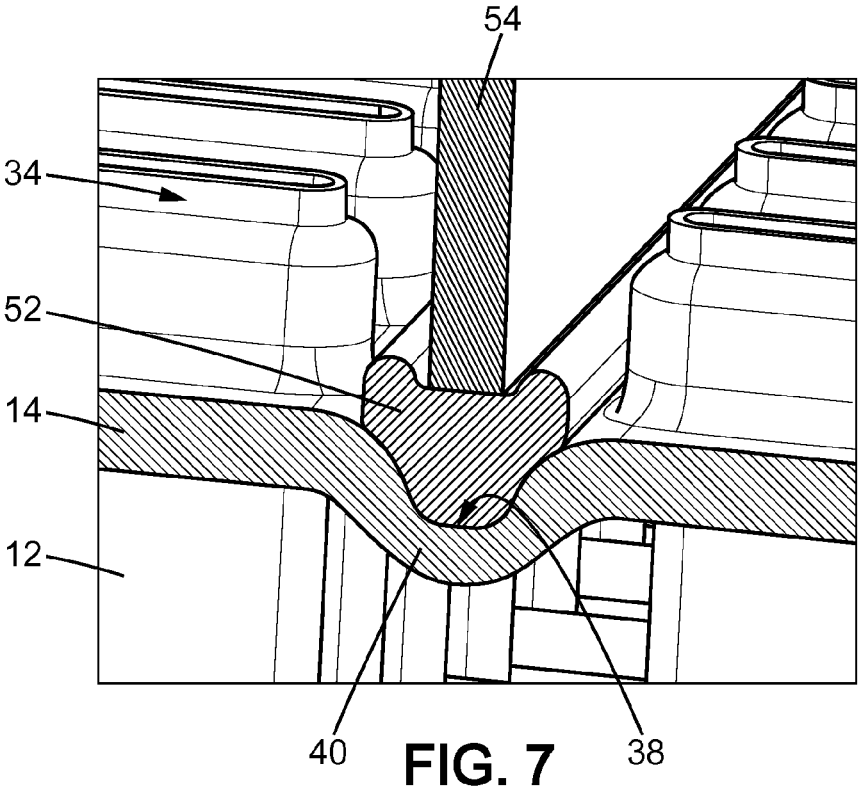
FIGS. 7 and 8 show respectively in a cut-away perspective and an exploded view a detail of the assembly of the heat exchanger of FIG. 1.
Figure 8:
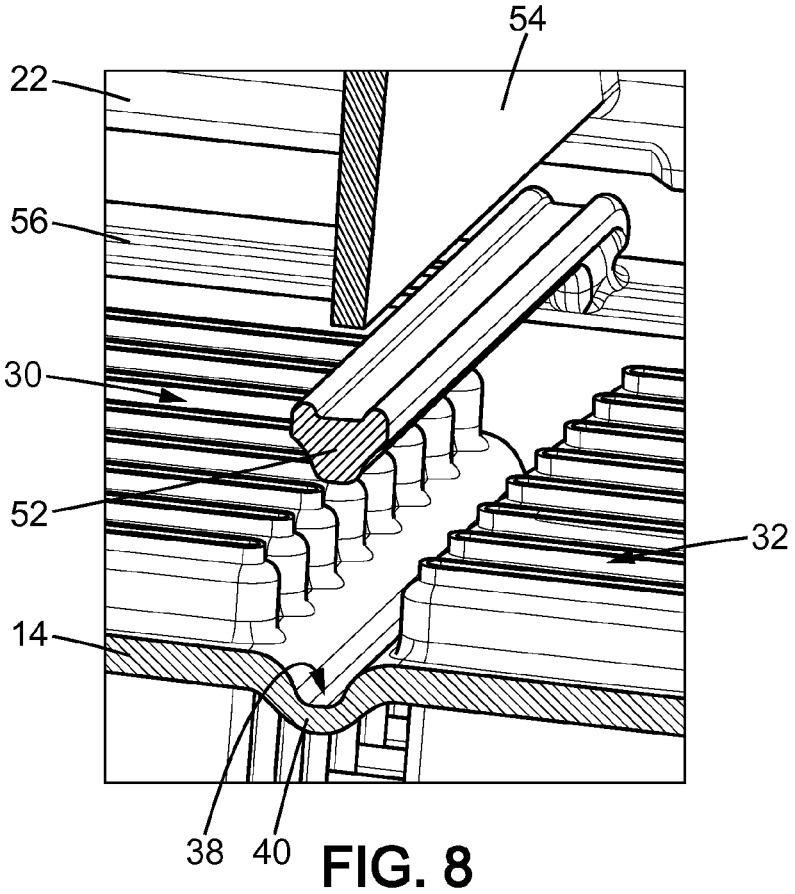

FIGS. 7 and 8 illustrate in more detail the assembly of the first cover 22 on the first collector plate 14. A seal ring 52 is received in the groove 38. The seal ring 52 has a U-shaped cross section in order to be received in the groove 38 and to receive a wall 54 of the first cover 22. The wall 54 makes it possible to separate the distribution space which is in fluidic communication with the water inlet 24, on the one hand, and the first tube bundle, on the other hand, and the collection space which is in fluidic communication with the water outlet 26, on the one hand, and the second tube bundle on the other hand.

As is more particularly visible in FIG. 8, the seal 54 is advantageously the central arm of a seal 56 in the shape of a figure of eight. The seal 56 may be of U-shaped cross section in order to receive the walls of the first cover 22 and thus provide the seal of these covers. The part of the seal 56 not received in the groove 38 is received in a recess 58 produced in the internal face 14*a* of the collector plate 14 and surrounding the first and second receiving zones 30, 32.

The invention is not simply limited to the embodiments described but has the possibility of numerous variants which are accessible to the person skilled in the art.

In particular, in the embodiment described, a single first cover forms the water inlet and water outlet of the heat exchange device. As a variant, however, the water inlet and water outlet are formed by separate covers.

The invention claimed is:

1. A collector plate for a motor vehicle heat exchanger, comprising:

a first receiving zone for tubes of a first tube bundle of the heat exchanger;

a second receiving zone for tubes of a second tube bundle of the heat exchanger; and a groove extending between the first and second receiving zones, the collector plate being thinner in a region of the groove, wherein the collector plate comprises a channel reducing a thickness of the collector plate from a first face of the collector plate, opposing a second face of the collector plate comprising the groove, and wherein the channel is a circular indentation on the first face of the collector plate.

2. The collector plate as claimed in claim 1, wherein the thinning in the region of the groove corresponds to a minimum thickness of the collector plate in the region of the groove, which is greater than 50% and/or less than 75% of a maximum thickness of the collector plate in the region of the groove.

3. The collector plate as claimed in claim 1, wherein the groove is defined by a fold of the collector plate.

4. The collector plate as claimed in claim 3, wherein the fold has a U-shaped cross section.

5. The collector plate as claimed in claim 4, wherein the thinning of the collector plate is located in a region of one or more angles of the U-shaped cross section of the fold.

6. The collector plate as claimed in claim 1, wherein on the second face of the collector plate the groove is configured to be oriented toward a cover forming with the collector plate at least one water chamber.

7. The collector plate as claimed in claim 1, of substantially rectangular shape, with rounded corners, wherein the collector plate comprises a rectangular shape with rounded corners, and wherein the groove extends in a longitudinal direction of the collector plate.

8. The collector plate as claimed in claim 1, wherein the first and/or the second receiving zones for tubes comprise a plurality of slots which are preferably parallel to one another, each slot out of the plurality of slots is configured to be traversed by the end of one respective tube.

9. The collector plate as claimed in claim 8, wherein said each slot out of the plurality of slots is at a top of a respective projection of the collector plate, wherein the respective projection is of an oblong shape, a length of the oblong shape being further preferably substantially perpendicular to the groove, and wherein the respective projections protrude from the second face of the collector plate with the groove.

10. The collector plate as claimed in claim 1, forming a recess about the first and second receiving zones, the groove leading into the recess on either side.

11. A heat exchange device for a motor vehicle comprising a radiator for cooling the engine of the motor vehicle, with two methodical passes, comprising:

a first and a second tube bundle;

a first collector plate and a second collector plate;

at least one first single cover fixed to the first collector plate and forming a water inlet and a water outlet; and a second cover fixed to the second collector plate and forming a guide for the water between the first tube bundle and the second tube bundle, the first collector plate comprising:

a first receiving zone for tubes of a first tube bundle of a heat exchanger, a second receiving zone for tubes of a second tube bundle of the heat exchanger, and a groove extending between the first and second receiving zones, wherein the first collector plate being thinner in a region of the groove, wherein the collector plate comprises a channel reducing a thickness of the collector plate from a first face of the collector plate, opposing a second face of the collector plate comprising the groove, and wherein the channel is a circular indentation on the first face of the collector plate.

12. The heat exchange device as claimed in claim 11, further comprising a first seal ring which is received in the groove of the first collector plate arranged between the first collector plate and a wall of the first cover, to separate a distribution space, which places the water inlet and the first tube bundle in fluidic communication, from a collection space, which places the water outlet and the second tube bundle in fluidic communication, the seal ring being of U-shaped cross section.

13. The heat exchange device as claimed in claim 11, wherein the first collection plate forms a recess about the first and second receiving zones, the groove leading into the recess on either side, the recess receiving a single second seal ring clamped between the first collector plate and a wall of the first cover, the seal ring being of U-shaped cross section.

14. The heat exchange device as claimed in claim 13, wherein the second seal ring has a shape of a figure of an eight with a central arm, the central arm forming the first seal ring which is received in the groove of the first collector plate.

15. A collector plate for a motor vehicle heat exchanger, comprising:

a first receiving zone for tubes of a first tube bundle of the heat exchanger;

a second receiving zone for tubes of a second tube bundle of the heat exchanger; and a groove extending between the first and second receiving zones, wherein the collector plate thinning in a region of the groove, thereby forming a deformation notch in the region of the groove, enabling adaptation of the collector plate to different expansions of the tubes of the first and second bundles, wherein the thinning facilitates relative pivoting of the first and second receiving zones about the thinning, wherein the collector plate comprises a channel reducing a thickness of the collector plate from a first face of the collector plate, opposing a second face of the collector plate comprising the groove, and wherein the channel is a circular indentation on the first face of the collector plate.

* * * * *